United States Patent [19]

Goodwin et al.

[11] Patent Number: 4,725,844

[45] Date of Patent: Feb. 16, 1988

[54] FIBER OPTICAL DISCRETE PHASE MODULATION SYSTEM

[75] Inventors: Francis E. Goodwin, Burke, Va.; Gordon R. Orme, Rancho Palos Verdes; Peter G. Petrelis, Huntington Beach, both of Calif.

[73] Assignee: TRW Inc., Redondo Beach, Calif.

[21] Appl. No.: 47,506

[22] Filed: May 1, 1987

Related U.S. Application Data

[63] Continuation of Ser. No. 749,360, Jun. 27, 1985.

[51] Int. Cl.[4] ..... H01Q 3/26

[52] U.S. Cl. ..... 342/374; 342/375

[58] Field of Search ..... 342/368, 370, 371, 372, 342/373, 374, 108, 375

[56] References Cited

U.S. PATENT DOCUMENTS

| | | | |
|---|---|---|---|
| 3,878,520 | 4/1975 | Wright et al. | 343/368 |
| 4,028,702 | 6/1977 | Levine | 343/374 |
| 4,079,379 | 3/1978 | Piesinger | 343/368 |
| 4,238,797 | 12/1980 | Shreve | 343/368 |
| 4,258,363 | 3/1981 | Bodmer et al. | 343/368 |
| 4,520,362 | 5/1985 | Charlot | 343/361 |

OTHER PUBLICATIONS

Levine, Use of Fiber Optic Frequency and Phase Determining Elements in Radar, 5/79, pp. 436–443.

*Primary Examiner*—Theodore M. Blum
*Assistant Examiner*—David Cain
*Attorney, Agent, or Firm*—Noel F. Heal; Robert J. Stern

[57] ABSTRACT

A technique for applying selected phase delays to an optical carrier signal, the phase delays being referenced to a radio-frequency (rf) subcarrier signal. The optical signal to be phase delayed is introduced into a phase delay network comprising multiple optical paths and multiple electro-optical switches, controllable by signals generated in switching logic. The selected delays can be introduced for purposes of data modulation, or for steering an antenna beam in a phased-array antenna. As applied to the phased-array antenna system, the invention includes a data modulator, a series of star couplers for splitting the optical carrier into multiple elemental carriers, and multiple phase shifters for applying selected phase shifts to the elemental carrier signals, to effect antenna beam steering.

17 Claims, 11 Drawing Figures

FIBER OPTICAL DISCRETE PHASE MODULATION SYSTEM

This application is a continuation, of application Ser. No. 749,360, filed June 27, 1985.

BACKGROUND OF THE INVENTION

This invention relates generally to fiber optical phase modulation techniques, and more particularly, to phase modulation in a discrete or digital sense, as in the modulation of the phase of a carrier signal with a sequence of digital signals. One common method of phase modulation is quadrature phase-shift keying (QPSK), in which digital signals are encoded as abrupt phase shifts in a radio-frequency carrier signal.

There are some applications involving QPSK, and other similar forms of phase modulation, in which the use of a conventional microwave transmitting medium is inadvisable or impracticable. One example is a phased array antenna used to provide inertialess scanning of an antenna beam. The principle of the phased array antenna, in a transmitting mode, is that each element of an antenna array is provided with a signal of which the phase is separately controlled. Control of the phase angle of each transmitting element allows the composite beam from the array to be angularly steered. In theory, the beam can be steered over an entire hemispherical region, but in practice arrays are employed to cover somewhat smaller segments of angular space.

One of the principal difficulties of phased array antenna systems is that each antenna element requires its own microwave feed line, which is typically a waveguide or coaxial cable, and its own phase shifter to control the phase of the signal applied to the antenna element. In many applications, the antenna has to be mounted for mechanical movement, giving rise to repeated flexing of the cables and waveguides. Another significant factor is that, for large antenna arrays, the weight of a hundred or more antenna feed cables can pose serious practical problems. In addition, signals transmitted in coaxial cables are prone to electromagnetic interference. Although it is generally appreciated that the use of optical fibers would obviate many of these problems, prior to this invention there has been no availble technique for phase- shifting an optical beam in a discrete or digital manner, either for purposes of data modulation or for antenna beam steering.

It will be appreciated from the foregoing that there is a need for a simplified technique for transmitting signals to or from phased array antennas, as well as a simplified approach for phase modulation of an optical signal. The present invention fulfills this need.

SUMMARY OF THE INVENTION

The present invention resides in a technique, including both method and apparatus, for applying discrete phase shifts to an optical carrier signal that has been modulated with a radio-frequency (rf) subcarrier signal. Each phase shift applied to the signal represents a selected phase difference with respect to the subcarrier signal.

Briefly, and in general terms, the apparatus of the invention comprises an optical input port and an optical output port, multiple optical signal paths, each having selected phase delays, optical switching means connecting the signal paths between the input ports and the output ports, and switching logic means, having input terminals for receiving phase delay selection signals, and output terminals connected to the optical switching means, and thereby actuate the switching means to select appropriate phase delays corresponding to the phase delay selection signals.

More specifically, in the phase-shifting apparatus of the invention the optical paths are optical waveguides of path lengths selected to provide desired phase-shift delays with respect to the subcarrier signal, and the optical switching means are electro-optical switches providing switching of an optical signal from one path to another upon the application of an electrical switching signal.

The specifics of the switching logic means will depend on the application of the phase-shifting apparatus. For example, if the apparatus is used as a quadrature phase-shift keying (QPSK) data modulator, the switching logic means will be responsive to two input signal lines conveying a data signal. In QPSK modulation, the phase of the rf subcarrier signal is shifted by either 0, 90, 180 or 270 degrees in accordance with the binary state of the data signals. When a zero phase shift is called for, the switching means are controlled to bypass all of the signal paths that would otherwise impose a phase delay. When a 90-degree phase delay is called for, an optical path is switched in to interpose the appropriate phase delay. Likewise, 180-degree and 270-degree delays are switched as needed. With appropriate switching, one 90-degree delay path and one 180- degree delay path can be used to provide all four possible QPSK delays.

As applied to phase shifting for purposes of antenna beam steering, the phase shifting apparatus of the invention employs basically the same structure. but a larger number of control signal bits, to provide finer resolution in the phase delay that is interposed. The two binary input data signals applied to a QPSK modulator provide a resolution of one part in four, i.e. 90 degrees, but a beam-steering module for phase shifting may employ four, five or more input bits, to provide a resolution of one part in sixteen, thirty-two, or more, corresponding to 22.5 degrees, 11.25 degrees, or some smaller resolution angle.

Another aspect of the invention is a phased array antenna feed system constructed in accordance with the foregoing principles of phase shifting. When used in a transmission mode, such a system comprises an optical carrier signal source, an rf subcarrier signal source used to modulate the optical carrier signal, and a data modulator constructed in the manner described above. The apparatus further includes star coupler means, for splitting the data-modulated signal into an array of separate signals of substantially equal power, and phase-shifting means for applying appropriate phase shifts to the separated signals, for application to a phased-array antenna. The phase-shifted signals can be transmitted over fibers to a remotely located antenna site, at which are located an array or detectors for converting the optical signals back to rf signals, and a corresponding array of antenna elements to which the phase-shifted signals are applied.

In the illustrative embodiment, the star coupler means includes a first star coupler for splitting the data-modulated signal into a plurality of vertically arrayed beams, and a plurality of additional star couplers for splitting each of the vertically arrayed beams into a plurality of horizontally arrayed beams. The phase-shifting means includes a vertical stack of phase shifters for application of selected phase shifts to the vertically arrayed beams, and a horizontal stack of phase shifters for applying selected phase shifts to the various vertical columns of the array of signals. Alternatively, the star coupler means can be employed to provide a rectangular array, and then the phase-shifting means can be applied to shift the phase of each elemental signal by a selected amount.

An analagous system may be employed in a receiving mode of a phased-array antenna. The receiving-mode system comprises an array of light sources, such as lasers, directly modulated by amplified rf signals received from multiple antenna elements, a set of optical fibers connecting the modulated lasers to a processing location, and an array of variable optical delay means similar to the ones in the transmitter system. Each variable optical delay means includes switchable delay paths to provide a selected phase delay for each elemental received signal. Finally, each phase-shifted signal is coupled to a detector for converting the received signal back into electrical form, and the multiple signals are combined in summing means.

In another form of the receiver system, an array of phase-shifted signals is mixed with signals received from the antenna elements. The resulting intermediate-frequency signals are combined and then data-demodulated.

It will be appreciated from the foregoing that the present invention represents a significant advance in the field of fiber optical communications. In particular, the invention provides a technique for phase-shifting an optical carrier signal by selected discrete amounts, either for purposes of data modulation, or for application to a phased array antenna. In the context of an antenna system, the invention comprises the elements of a transmitting or receiving system by means of which an antenna beam can be steered non-mechanically and without the use of coaxial cables or waveguides. Other aspects and advantages of the invention will become apparent from the following more detailed description, taken in conjunction with the accompanying drawings.

DESCRIPTION OF THE PREFERRED EMBODIMENTS

Figure 2:
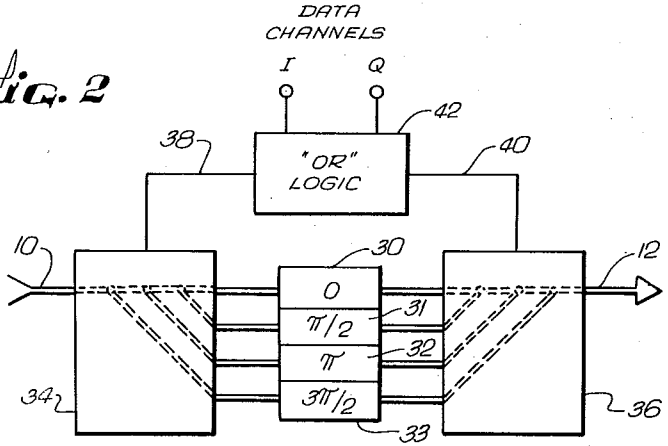
FIG. 2 is a simplified block diagram similar to FIG. 1, but employing OR logic instead of AND logic.

As shown in the drawings for purposes of illustration, the present invention is concerned with a novel approach to phase modulation in fiber optical communication systems and signal distribution in phased array antenna systems. In the past, phased array antenna systems have employed cumbersome waveguide or coaxial manifolds, together with multiple ferrite or semiconductor phase shifters.

In accordance with the invention, phase shifting of a radio-frequency (rf) signal is achieved by shifting the phase of an optical carrier signal on which the rf signal is modulated as a subcarrier. The invention has two significant aspects: the use of this principle as a data modulation technique, and the use of the same principle to apply selected phase shifts to elemental signals used in a phased array antenna.

Figure 1:
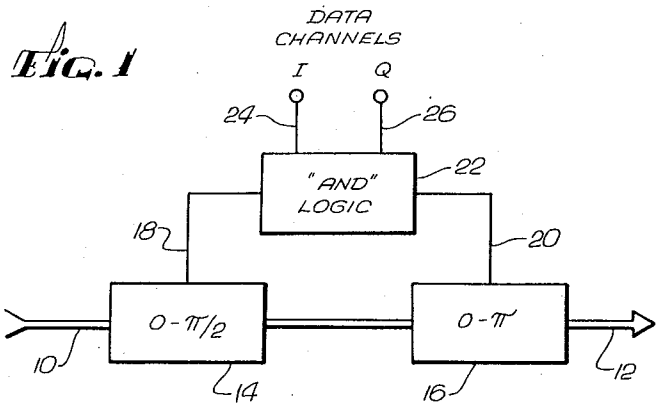
FIG. 1 is a simplified block diagram of a fiber optical data modulator in accordance with the invention.

FIG. 1 shows the basic phase shifting approach of the invention as applied to data modulation. In conventional quadrature phase-shift keying, an rf carrier signal is shifted in phase by 0, 90, 180 and 270 degrees, depending on the state of a digital signal being used to modulate the phase of the rf signal. In the data modulator of the invention, the rf signal is combined with an optical signal as a subcarrier, in a conventional manner to be described, and the optical signal is then subjected to selected phase delays equivalent to the desired phase shifts of the rf subcarrier. The optical signal is transmitted to the data modulator over an optical waveguide, indicated by reference numeral 10, and is transmitted from the modulator over another optical waveguide 12. The modulator includes a first switchable optical phase delay 14 and a second such phase delay 16, coupled in sequence between the input and output waveguides 10 and 12. The first delay 14 is switch-selectable to provide a phase delay of either zero or $\pi/2$ radians, and the second delay 16 is switch-selectable to provide a phase delay of either zero or $\pi$ radians, both phase delay angles being measured with respect to the rf subcarrier signal.

Each of the switchable delays 14 and 16 has an associated electrical control line 18 and 20, respectively, and these are controlled by AND logic 22 to which two data signal lines 24 and 26 are applied as inputs designated the in-phase (I) and quatrature (Q) components. The specific nature of the AND logic 22 will depend on the type of phase modulation being performed. In QPSK, for example, the states of the switch-selectable delays 14 and 16 will correspond to the respective binary values of the data inputs. For I,Q=0,0 neither delay is switched in and the phase delay is zero. For I,Q=0,1 the phase delay is $\pi/2$. For I,Q=1,0 the phase delay is $\pi$. Finally, for I,Q=1,1 the phase delay is $3\pi/2$, with both delays switched in.

FIG. 2 shows an alternative embodiment of the data modulator, in which four separate optical delay paths 30–33 are controlled by two sets of optical switches 34 and 36 operating in parallel. The sets of switches 34 and 36 are controlled by signals on lines 38 and 40, respectively, from OR logic 42. In accordance with this control logic, only one of the delay paths 30–33 is switched in at any time, providing delays of 0, $\pi/2$, $\pi$, and $3\pi/2$, respectively.

Figure 3:
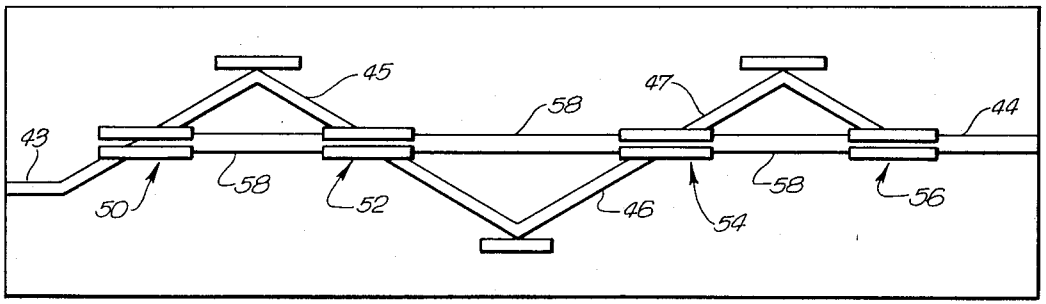
FIG. 3 is a plan view of the optical components of the data modulator of FIG. 1.

FIG. 3 shows another variant of the data modulator, comprising an input waveguide 43, an output waveguide 44, and three delay paths 45, 46 and 47, each of which interposes a phase delay of 90 degrees or $\pi/2$. Also included are four electro-optical switches 50, 52, 54 and 56, for selecting between delay paths and a straight-through waveguide 58. By selective actuation of the switches 50, 52, 54 and 56, the energy path between the input and output waveguides can be selectively diverted through one, two, all or none of the delay paths, to provide the appropriate data modulating phase shifts.

The electro-optical switches, such as 50, 52, 54 and 56, are devices in which an optical property, such as refractive index, is modifiable by the application of an electric field. A change in refractive index can result in total internal reflection within the switch, thereby diverting an optical signal to a different output port upon the application of an electrical control signal.

Figure 4:
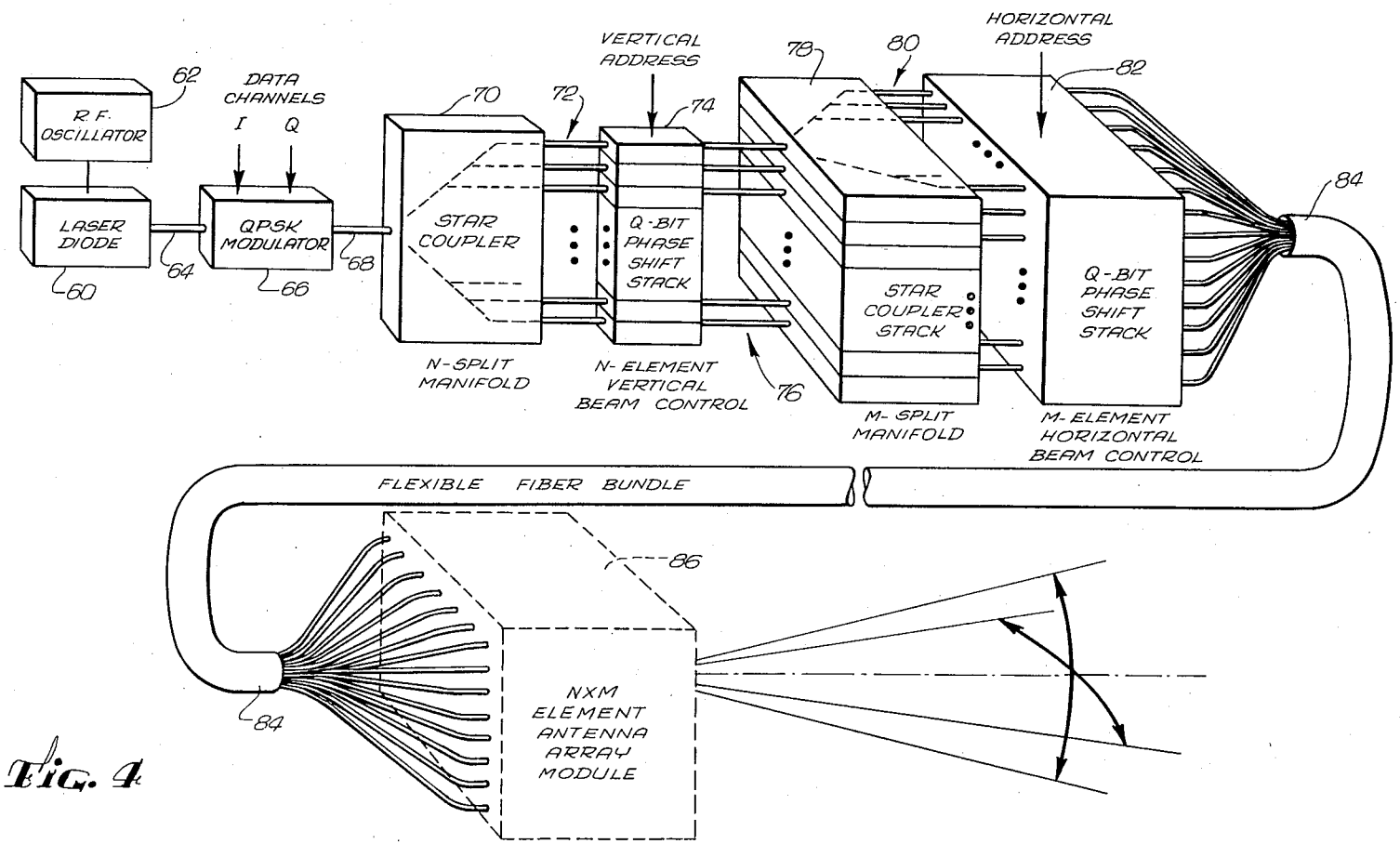
FIG. 4 is a block diagram of an inertialess antenna scanning system employing the principles of the invention.

FIG. 4 shows how the principles of the invention can be applied to an inertialess scanning system using a phased array antenna. A laser diode 60 provides a source for the optical carrier signal, and an rf oscillator 62 provides the rf subcarrier signal, producing an rf modulated optical carrier on waveguide 64. Amplitude modulation of the optical carrier by the rf subcarrier may be effected by direct current modulation, which is suitable for rf frequencies up to about 10 GHz (gigahertz). For higher frequencies, one of two other approaches may be used. In one approach, the laser 60 is of the cleaved-coupled-cavity type and is mode-locked at the desired subcarrier frequency. An external mirror is used to provide a total cavity length to achieve the mode-locked output modulation. The alternative is a continuous-wave (CW) laser that is externally modulated with an electro-optical modulator.

In any event, the rf-moduated optical carrier is further modulated by a data modulator 66 of the type described with reference to FIGS. 1–3, thus providing on output waveguide 68 an optical carrier that has an rf subcarrier, which is in turn phase-modulated by data signals applied to the data modulator 66.

This modulated signal is next split into N substantially equal signals by an optical star coupler 70 having one input port and N output ports coupled to N output waveguides 72. These waveguides are coupled to a stack of N vertical beam control phase shifters 74, each of which operates on the same principle as the data modulator. Vertical address signals fed into the stack of phase shifters 74 to apply selected phase shifts to the signals in waveguides 72, depending on the degree of antenna beam deflection that is required in a vertical plane. Thus, the signals on output waveguides 76 from the phase shifters 74 are phase shifted both for data modulation and for vertical beam deflection.

These N signals are then fed to a stack of M star couplers 78, each of which splits one of the N signals into M horizontally arrayed signals, yielding an N-by-M array of signals in waveguides 80. These signals are next fed to a stack of M additional phase shifters 82, which are connected to apply phase shifts for horizontal angular beam deflection. Thus each of the shifters 82 applies phase shift to a particular vertical column of signals. The resultant array of waveguides 84 has each of its elements phase-shifted by a selected amount for beam deflection in a phased array antenna, and has all of its elements uniformly phase-shifted by a different amount, for data modulation. The waveguides 84 may be formed as a flexible bundle of fibers, for convenient transmission to the antenna, which may be located at some distance from the modulating and phase-shifting components. The waveguides 84 are terminated at an N-by-M antenna array module 86, the details of which will be described, and which depend on whether the system is to operate as a transmitter or as a receiver.

Figure 5:
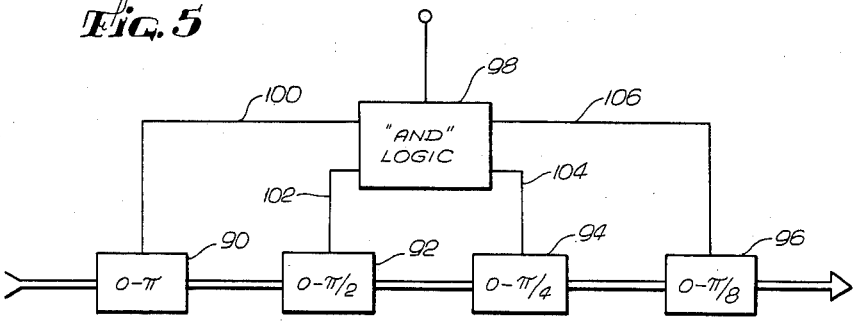
FIG. 5 is a simplified block diagram of a phase-shifting device for use in the system of FIG. 4.

The individual phase shifters 74 and 82 may be constructed in accordance with the block diagram of FIG. 5, which includes four phase switchable delays 90, 92, 94 and 96, together with AND logic 98 providing control signals over lines 100, 102, 104 and 106, respectively. Control signals are applied to the AND logic 98 to select the switching of appropriate delays in the optical path. The delays 90, 92, 94 and 96 have delay values of $\pi$, $\pi/2$, $\pi/4$ and $\pi/8$, respectively, and provide for a net delay in the range $0–15\pi/8$, in increments of $\pi/8$. Thus, the delay circuit of FIG. 5 provides four bits of resolution, i.e. one part in sixteen. The AND logic 98 in its most elementary form may be an encoder having sixteen input lines, one of which is energized to indicate a particular phase delay, and four output lines 100, 102, 104, and 104, to convey the corresponding binarily weighted value of the input signal to the phase delays.

Figure 6:
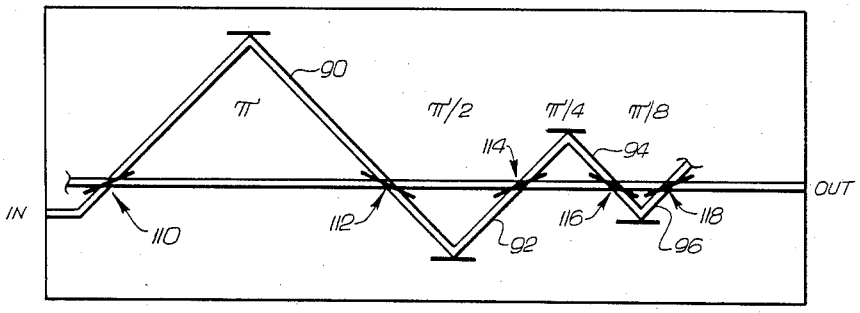
FIG. 6 is a plan view of the optical components of the phase-shifting device of FIG. 5.

FIG. 6 shows an integrated optical implementation of the phase shifter of FIG. 5, including the same phase delays 90, 92, 94 and 96, and five switching points 110, 112, 114, 116 and 118. Each switching point has two states, one of which allows transmission of light along both intersecting waveguides, and the other of which provides for reflection at the solid line shown at each switching point. The AND logic 98 is a little more complex than was indicated with reference to FIG. 5, since switching in a particular delay element requires the cooperation of two switch points. The logic is simple to derive, however, as indicated by the following truth table:

| Desired delay | | | | State of switch points (1 = energized) | | | | |
|---|---|---|---|---|---|---|---|---|
| $\pi$ | $\pi/2$ | $\pi/4$ | $\pi/8$ | 110 | 112 | 114 | 116 | 118 |
| 0 | 0 | 0 | 0 | 1 | 0 | 0 | 0 | 0 |
| 0 | 0 | 0 | 1 | 1 | 0 | 0 | 1 | 1 |
| 0 | 0 | 1 | 0 | 1 | 0 | 1 | 1 | 0 |
| 0 | 0 | 1 | 1 | 1 | 0 | 1 | 0 | 1 |
| 0 | 1 | 0 | 0 | 1 | 1 | 1 | 0 | 0 |
| 0 | 1 | 0 | 1 | 1 | 1 | 1 | 1 | 1 |
| 0 | 1 | 1 | 0 | 1 | 1 | 0 | 1 | 0 |
| 0 | 1 | 1 | 1 | 1 | 1 | 0 | 0 | 1 |
| 1 | 0 | 0 | 0 | 0 | 1 | 0 | 0 | 0 |
| 1 | 0 | 0 | 1 | 0 | 1 | 0 | 1 | 1 |
| 1 | 0 | 1 | 0 | 0 | 1 | 1 | 1 | 0 |
| 1 | 0 | 1 | 1 | 0 | 1 | 1 | 0 | 1 |
| 1 | 1 | 0 | 0 | 0 | 0 | 1 | 0 | 0 |
| 1 | 1 | 0 | 1 | 0 | 0 | 1 | 1 | 1 |
| 1 | 1 | 1 | 0 | 0 | 0 | 0 | 1 | 0 |
| 1 | 1 | 1 | 1 | 0 | 0 | 0 | 0 | 1 |

Figure 7A:
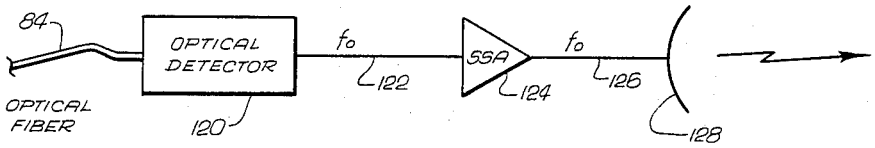
FIG. 7*a* is a fragmentary block diagram showing direct optical to radio-frequency conversion in the system of FIG. 4.
Figure 7B:
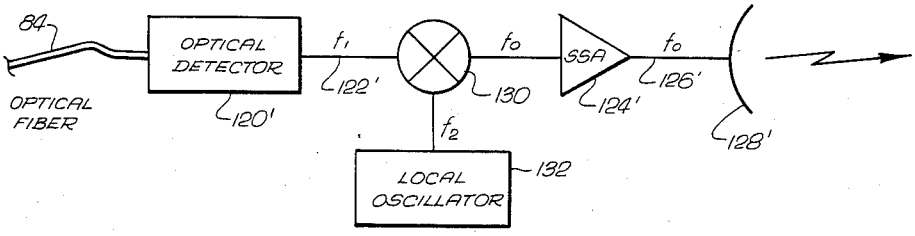
FIG. 7*b* is a fragmentary block diagram showing an alternative optical to radio-frequency conversion technique.

FIG. 7*a* shows one elemental portion of the antenna array module 86 (FIG. 4) as used in a transmitting mode. Each element includes an optical detector 120, for directly converting the optical signal on line 84 to an rf signal on line 122. This signal is amplified in a solid-state amplifier 124, and transmitted over line 126 to an antenna array element 128. FIG. 7*b* illustrates a variant of this structure, in which an optical detector 120' produces rf output at frequency $f_1$, which is up-converted in a mixer 130 to a different frequency $f_0$, for subsequent amplification in amplifier 124' and transmission to antenna element 128'. The mixer 130 combines the signal at frequency $f_1$ with a signal from a local oscillator 132 at frequency f2, to produce the output signal at frequency $f_0$, where $f_0=f_2+/-f_1$. The local oscillator signal shown at 132 should in fact be derived from a single oscillator source and a set of rf or optical manifolds or power dividers (not shown), to provide N×M identical local oscillator sources.

Figure 8A:
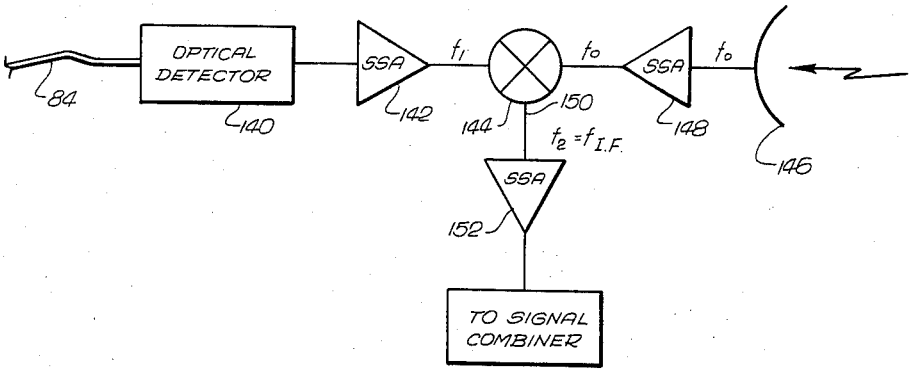
FIGS. 8*a* and 8*b* together are a block diagram of a receiver element and intermediate-frequency signal combiner, illustrating one approach to implementation of a receiver system.
Figure 8B:
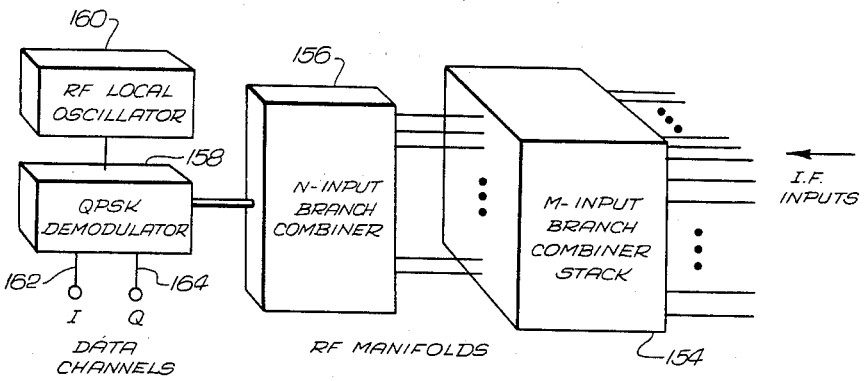

FIGS. 8*a* and 8*b* illustrate one approach to the construction of a receiver system using the principles of the present invention. Each elemental portion of the antenna array module 86 (FIG. 4) includes an optical detector 140, an amplifier 142 for amplifying the detector output, and a mixer 144. A received signal from elemental antenna 146 is amplified in another amplifier 148, and mixed with the detected or demodulated optical signal in the mixer 144, to produce an intermediate-frequency ("if") signal on output line 150, which is amplified in another amplifier 152, and transmitted to one elemental input of the signal combiner shown in FIG. 8*b*. In the receiving mode, there will be no data modulation on the signal derived from the detector 140. However, the "if" signal applied to the signal combiner of FIG. 8*b* will be phase shifted by the local oscillator 132 and in accordance with beam steering requirements of the receiver system. The signal combiner of FIG. 8*b* includes a first branch combiner 154 for reducing each row of elemental signals to a single accumulated sum signal, and a second branch combiner 156 for combining the row summation signals into a single output. This output is applied to a QPSK demodulator 158, to which a local rf oscillator 160 is connected, thereby providing data signals on output lines 162 and 164.

Figure 9:
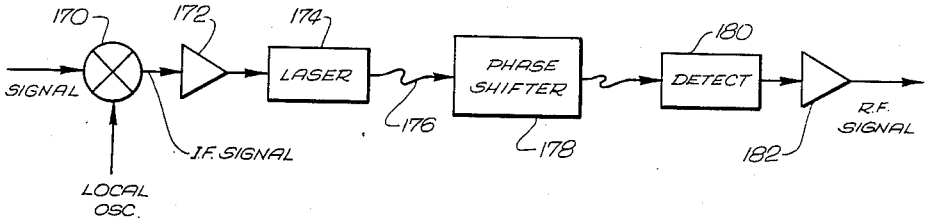
FIG. 9 is a fragmentary block diagram of a receiver system employing the same principles as the transmitter system.

An alternative approach to a receiver system is shown in FIG. 9, which includes a mixer 170 for down-conversion of an elemental received signal to an intermediate frequency. If the received signal frequency is low enough, this down-conversion step may be omitted. The apparatus further includes an amplifier 172, the output of which is applied to modulate a laser 174. A fiber link 176 from the laser is connected to a phase shifter 178 of the same type disclosed earlier. The phase shifter is controlled to apply a beam steering phase shift to the elemental received signal, which is then passed to a detector 180, for conversion to an rf signal. The rf signal then passes through an amplifier 182 and is applied as one of an array of inputs to a signal combiner and demodulator, of the same configuration shown in FIG. 8*b*. In order to minimize unacceptable side lobe distortion, and in accordance with principles and practices well known in the art, each of the amplifiers 182 may have an attenuator element to form an amplitude weighting network suitably selected by a skilled worker to minimize side lobe generation.

It will be appreciated from the foregoing that the present invention represents a significant advance in the field of communication systems employing optical fibers. In particular, the invention provides a novel technique for phase-modulating an optical carrier signal by discrete increments of an rf subcarrier and for distributing the signal to many array elements. The technique can be used for both data modulation and for phase shifting for angular rotation of a phased-array antenna beam. It will also be appreciated that, although the invention has been described in detail for purposes of illustration, various modifications may be made without departing from the spirit and scope of the invention. Accordingly, the invention is not to be limited except as by the appended claims.

We claim:

1. A phased-array antenna feed system, comprising:

an optical carrier signal source;

a radio-frequency (rf) subcarrier signal source coupled to amplitude-modulate the optical carrier signal;

data modulator means, including switch-selectable optical delay paths for controlling the phase of the optical carrier signal by selected increments of subcarrier phase angle, to produce a data-modulated signal;

star coupler means, for splitting the data-modulated signal into an array of separate signals of substantially equal power;

phase-shifting means, for applying selected phase shifts to the separate signals, to effect beam steering in a phased-array antenna, wherein the phase-shifting means includes a plurality of phase shifters, each having multiple optical signal paths, multiple electro-optical switching means, and switching logic means for selecting a particular phase delay; and detector means for converting the data-modulated and phase-shifted optical signals to rf signals for application to the antenna.

2. A phased-array antenna feed system as set forth in claim 1, wherein:

the star coupler means includes a first star coupler for splitting the data-modulated signal into a plurality of beams arrayed in a single column, and a plurality of additional star couplers for splitting each of the beams arrayed in a column into a plurality of beams arrayed a row; and the phase-shifting means includes a first stack of phase shifters for application of selected phase shifts to the beams arrayed in a column, to effect vertical beam control, and a second stack of phase shifters for applying selected phase shifts to selected columns of beams, to effect horizontal beam control.

3. A phased-array antenna feed system as set forth in claim 1, wherein:

the star coupler means produces and two-dimensional array of beams; and the phase-shifting means includes multiple phase shifters for applying selected phase shifts to corresponding beams in the array, to effect angular beam control.

4. A phased-array antenna feed system for use as a receiver, said system comprising:

an optical carrier signal source;

a radio-frequency (rf) subcarrier signal source coupled to amplitude-modulate the optical carrier signal;

star coupler means, for splitting the resulting signal into an array of separate signals of substantially equal power;

phase-shifting means, for applying selected phase shifts to the separate signals, to effect beam steering in a phased-array antenna, wherein the phase-shifting means includes a plurality of phase shifters, each having multiple optical signal paths, multiple electro-optical switching means, and switching logic means for selecting a particular phase delay;

detector means for converting the data-modulated and phase-shifted optical signals to rf signals;

mixing means for combining these rf signals with other rf signals received from corresponding antenna elements, to obtain intermediate-frequency signals;

signal summation means, for combining the elemental intermediate-frequency signals into one intermediate-frequency signal; and data demodulation means, for producing data signal from the single intermediate-frequency signal.

5. A phased-array antenna feed system for use as a receiver, said system comprising:

an array of optical signal sources, each of which is directly modulated by amplified rf signals received from an array of antenna elements;

light-conducting means for connecting the optical signal sources to a processing site;

a plurality of phase-shifters connected to the light-conducting means, each phase shifter having multiple optical delay paths, multiple opto-electrical switches and switching logic means for selecting a phase delay for each elemental optical signal;

a plurality of detectors, for converting the elemental optical signals into radio-frequency (rf) signals;

signal summation means, for electrically combining the rf signals and producing a single rf output signal indicative of data received from a selected antenna direction; and data demodulation means, for deriving data signals from the single rf output signal.

6. A method of angularly deflecting a phased-array antenna beam, comprising the steps of:

amplitude-modulating an optical carrier signal with a radio-frequency subcarrier signal;

applying selected phase delays to the optical carrier signal, equivalent to phase delay angles of the rf subcarrier signal, to modulate the carrier signal with digital data;

splitting the data-modulated carrier signal into an array of elemental optical signals;

applying selected phase delays to the elemental optical signals to effect angular steering of the antenna beam;

amplitude-demodulating the elemental optical signals in a plurality of detectors, to obtain a set of data-modulated, phase-shifted elemental rf signals; and applying these rf signals to antenna elements in a phased-array antenna.

7. A method as set forth in claim 6, wherein the step of splitting the carrier signal includes:

passing the carrier signal through a first star coupler to produce a linear array of signals; and passing each of the array signal through an additional star coupler to produce a two-dimensional array of elemental optical signals.

8. A method as set forth in claim 6, wherein the steps for applying selected phase delays include:

introducing the carrier signal into a phase-delay network having multiple alternate paths, each having a different phase delay; and switching the phase-delay network by means of opto-electrical switches, to provide the desired phases delay.

9. A method of angularly deflecting a phased-array receiving antenna beam, comprising the steps of:

amplitude-modulating an optical carrier signal with a radio-frequency subcarrier signal;

splitting the amplitude-modulated carrier signal into an array elemental optical signals;

applying selected phase delays to the elemental optical signals to effect angular steering of the antenna beam;

amplitude-demodulating the elemental optical signals in a plurality of detectors to obtain a set of phase-shifted elemental rf signals; and mixing these elemental rf signal with corresponding elemental rf siynal received from antenna elements, to obtain elemental intermediate-frequency signals;

combining the elemental intermediate-frequency signals to produce a single intermediate-frequency signal; and demodulating the intermediate-frequency signal to obtain data signals.

10. A method of angularly deflecting a phased-array receiving antenna beam, comprising the steps of:

amplitude-modulating a plurality of optical signal sources with elemental radio-frequency (rf) subcarrier signals derived from correponding receiving antenna elements, to produce a plurality of elemental optical carrier signals;

applying selected phase delays to the elemental carrier signals, to effect antenna beam steering;

amplitude-demodulating the elemental carrier signals, to produce elemental rf signals that have been phase-shifted for antenna beam steering; and combining by summation the elemental rf signals into a single rf signal.

11. Apparatus for applying selected discrete phase shifts to an optical carrier signal, said apparatus comprising:

an optical input port and an optical output port;

multiple optical waveguides, defining multiple optical signal paths, each having selected phase delays corresponding to phase delays with respect to a subcarrier signal modulated onto the optical carrier signal;

multiple optical switching means, including electro-optical switches providing switching of an optical signal from one path to another upon the application of an electrical switching signal connecting the signal paths between the input ports and the output ports; and switching logic means, having input terminals for receiving phase delay selection signals, and output terminals connected to the optical switching means, to actuate the switching means and select appropriate phase delays corresponding to the phase delay selection signals;

and wherein the apparatus is used for quadrature phase-shift keying (QPSK) phase modulation, and the optical waveguides provide phase delays of 0, 90, 180, or 270 degrees with respect to the subcarrier signal.

12. Apparatus as set forth in claim 11, wherein:

there are four alternate waveguides defining the optical paths, and four sets of electo-optical switches for selecting one of the waveguides at any time; and the switching logic means includes means for generating a control signal on one of four output terminals, connected to one of the four sets of electro-optical switches, in response to phase delay switching signals.

13. Apparatus as set forth in claim 11, wherein:

there are two separate waveguides defining the multiple optical paths, one with a phase delay of 90 degrees and the other with a phase delay of 180 degrees;

the electro-optical switches are switchable to interpose one, both, or none of the two waveguides in the optical light path through the device; and the switching logic means includes means for generating control signals for selecting either one or both of the two waveguides.

14. A method for applying selected phase delays to an optical carrier signal that has been amplitude-modulated with a radio-frequency (rf) subcarrier signal, the method comprising the steps of:

inputting the optical carrier signal to a phase delay network having a plurality of alternate optical waveguide paths, each providing a different delay of 0, 90, 180, or 270 degrees with respect to the phase of the rf subcarrier signal;

applying phase delay selection signals to switching logic means;

generating in the switching logic means a set of corresponding control signals; and applying the control signals to electro-optical switches to control the flow of the optical carrier signal through the phase delay network in such a manner as to achieve the desired phase delay for quadrature phase-shift keying (QPSK) phase modulation.

15. A method as set forth in claim 14, wherein:

the step of generating control signals includes generating a control signal on one of four output terminals, for connection to the electro-optical switches, in response to data signals.

16. A method as set forth in claim 14, wherein:

there are two separate waveguides making up the alternate optical waveguide paths, one with a phase delay of 90 degrees and the other with a phase delay of 180 degrees; and the step of applying the control signals is effective to switch the electro-optical switches to interpose one, both, or none of the two waveguides paths in the optical light path through the device.

17. A method for applying selected phase delays to an optical carrier signal that has been modulated with a radio-frequency (rf) subcarrier signal, the method comprising the steps of:

inputting the optical carrier signal to a phase delay network having a plurality of alternate optical waveguide paths, each providing a different delay to the phase of the rf subcarrier signal;

applying phase delay selection signals to switching logic means;

generating in the switching logic means a set of corresponding control signals; and applying the control signals to electro-optical switches to control the flow of the optical carrier signal through the phase delay network in such a manner as to achieve the desired phase delay for phase-shift keying (PSK) phase modulation.

* * * * *